United States Patent [19]

Prevot et al.

[11] Patent Number: 4,864,692

[45] Date of Patent: Sep. 12, 1989

[54] HINGE WITH AXIAL PIN LOCKING SYSTEM FOR DOORS OR WINDOWS

[75] Inventors: Gérard Prevot, Willerwald; Daniel Vigreux, Biberkirch, both of France

[73] Assignee: Ferco International, Sarrebourg, France

[21] Appl. No.: 101,639

[22] Filed: Sep. 28, 1987

[30] Foreign Application Priority Data

Sep. 30, 1986 [FR] France ..... 86 13785

[51] Int. Cl.[4] ..... E05D 5/12

[52] U.S. Cl. ..... 16/381; 16/380; 16/386

[58] Field of Search ..... 16/273, 380, 381, 382, 16/385, 386

[56] References Cited

U.S. PATENT DOCUMENTS

| | | | |
|---|---|---|---|
| 2,797,433 | 7/1957 | Hager | 16/381 |
| 3,135,013 | 6/1964 | Parsons | 16/380 |
| 4,135,273 | 1/1979 | Holmes | 16/381 |

FOREIGN PATENT DOCUMENTS

| | | | |
|---|---|---|---|
| 2750310 | 5/1979 | Fed. Rep. of Germany | 16/273 |
| 3401245 | 7/1985 | Fed. Rep. of Germany | 16/273 |

*Primary Examiner*—Richard K. Seidel

*Attorney, Agent, or Firm*—Sandler & Greenblum

[57] ABSTRACT

A hinge for doors or windows which includes a first blade fitted to a door or window and a second blade attached firmly to the casing of the door or window. One of these blades is provided with a central knuckle placed in the free space between two end knuckles attached firmly to the other blade, and one pin engaged in these knuckles ensures the free rotation of one blade as compared to the other. The aforesaid central knuckle comprises, furthermore, a pore that opens into one or more housings into which are engaged plugs provided with jaws fitted with catches that enter into peripheral grooves made in the pin. These jaws take the shape of a cylinder with an outer diameter equal to the inner diameter of the boring of the housings, less twice, at least, the thickness of the catches.

4 Claims, 2 Drawing Sheets

HINGE WITH AXIAL PIN LOCKING SYSTEM FOR DOORS OR WINDOWS

FIELD OF THE INVENTION

The invention relates to a hinge for doors or windows, comprising one blade fitted to the leaf and a second blade attached firmly to the casing of the door or the window, one of these blades being provided with a central knuckle placed in the free space between two end knuckles attached firmly to the other blade, and one pin engaged in these knuckles, ensuring the free rotation of one blade as compared to the other, the aforesaid central knuckle being provided, furthermore, with one plug, at least, for locking the pin axially.

THE PRIOR ART

The use of hinges is already known which ensure the free rotation of the leaf of a door or a window as compared to the casing, with this rotation made feasible around a vertical or a horizontal axis. Very often, for reasons of size or easier assembly, it is necessary to engage the pin into the knuckles of the hinge blades either from above or from below. However, there is a risk, simply under the effect of gravity, that the pin slides downwards and disengages from the knuckles, thus causing the dissolution of the articulation between the blade attached firmly to the leaf and the blade fitted to the casing. For this reason, these hinges comprise split rings or clips designed to resist the shifting of the pin in the axial direction, but as such split rings or clips are frequently small-sized, they increase assembling difficulties, require the use of tools and their reliability is poor.

Another solution for locking the pin in its axial direction consists in securing the latter by means of a bolt attached firmly to a knuckle of one of the blades. In addition to the fact that this solution has the same drawbacks as those mentioned above i.e. longer assembling time and use of tools, this bolt will lock the pin not alone in its axial direction but also in its free rotation around its axis. Consequently, the pin will be under stress in the same places always and will therefore tend to wear out quickly, thus producing a free motion in a direction perpendicular to the axis of rotation of the leaf, which may affect the proper closing of the door of the window. This drawback also exists where a tight fit between the pin and the blade knuckles is provided for in order to prevent the pin from sliding downwards. This tight fit requires exercising a certain force on the pin to make it engage the two blades of the hinge.

On the other hand, a hinge for doors or windows is already known, which comprises one blade fitted to the leaf and a second blade attached firmly to the casing of the door or the window, with one of these blades provided with a central knuckle placed in the free space between two end knuckles attached firmly to the second blade, with a pin engaged into these knuckles ensuring the free rotation of one blade as compared to the other. The central knuckle has a boring into which are engaged, from both sides, bushes provided with supporting brackets resting against the end faces of the knuckle. These bushes meet in the central section of the boring and form a lining for the latter. The guiding function of the pin is therefore being ensured by these bushes. An inner peripheral bulge at the end of the bushes engaged into the boring enters a peripheral recess of the pin, thus resisting the shifting of the latter in the direction of its axis. A chamfer on the outer periphery at the level of the bulges allows the latter to push through when the pin enters the knuckles.

The hinge according to the prior art has a certain number of drawbacks. As the guiding of the pin is ensured only by the plastic material bushes, these latter suffer premature wear. Furthermore, when the pin is being inserted, the inner bulges are subjected to considerable effort and their locking effect has decreased significantly after several assemblies and disassemblies of the hinge. As a matter of fact, the withdrawal of the peripheral bulges when a pin of larger diameter passes through is achieved by elastic deformation of the plastic material. This deformation takes place at the bulge, this being the only place possible for obtaining a widening of the latter's inner diameter via the outer peripheral chamfer on the bush. Each time the peripheral bulge passes over a surface irregularity such as a burr or simply when it passes through the peripheral groove of the pin, the material is exposed to considerable wear. Furthermore, disengaging the pin from the knuckles requires great effort to be exerted on the aforesaid pin in order to cause again a widening of the inner diameter of the bulge.

Another drawback of the hinge as described in the aforesaid prior document becomes apparent. Considering, as a matter of fact that the bushes are continuous at the centre of the boring of the central knuckle, the diameter of the latter needs to be increased right through. The knuckle, however, must have a certain mechanical resistance to be able to resist the efforts it is being exposed to. This resistance can be obtained only by oversizing the outer diameter of the central knuckle. The result is a larger size of the hinge. Another solution would consist in decreasing the diameter of the pin, but in this event, the consequence would be a central knuckle of diminished strength.

The purpose of this invention is to remedy all of the aforesaid drawbacks and it proposes a hinge for doors or windows with great resistance to wear, in particular where the pin and the knuckles but also where means allowing for locking the pin in its axial direction are concerned, without any need to increase the sizes of one or the other component of the hinge. Another objective of this invention is to make the assembly easier so that it does not require any tools.

In view of this, the invention concerns a hinge for doors or windows, comprising one blade fitted to the leaf and a second blade attached firmly to the casing of the door or the window, with one of these blades provided with a central knuckle placed in the free space between two end knuckles at the other blade and comprising a boring that opens into one or several housings into which are engaged plugs provided with jaws fitted with catches that enter into peripheral grooves made in a pin engaged into the various knuckles and ensuring the free rotation of one blade as compared to the other.

The advantages obtained through this invention consist essentially in that the guiding function of the pin is dissociated from the axial locking of the latter. As a matter of fact, this guiding function is ensured by the boring machined in the central knuckle and the diameter of which is adjusted to that of the pin. From this results, of course, a longer life for the hinge and, in particular, for the plugs engaged in the housing(s) into which opens this boring of the central knuckle. Another advantage consists in that this invention makes the installation and the removal of the leaf of a door or a window easier. This results partly from the fact that the user is able to insert the pin partly into the knuckles of the hinge while ensuring the axial locking of the aforesaid pin. As a matter of fact, only the catches of the first plug encountered in the direction of insertion of the pin into the knuckles can be engaged, in co-operation with a peripheral groove made in the aforesaid pin. In this manner, if several adjustments are required, e.g. of the blade fitted to the casing, withdrawing the pin from the knuckles will be that much easier.

The invention is detailed in greater detail below by means of drawings that show one form of embodiment only.

Figure 1:
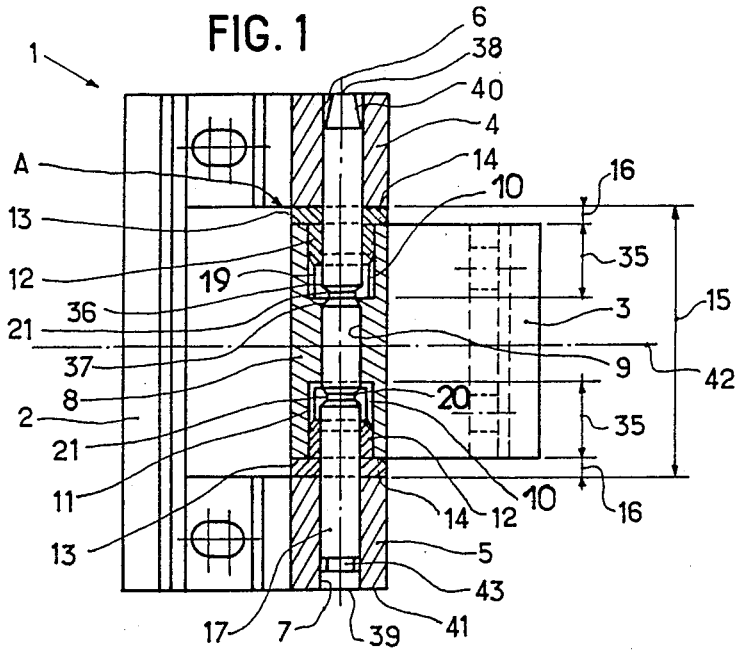
FIG. 1 is a plan view according to a longitudinal section of the hinge for doors or windows.

We refer to FIG. 1.

The invention relates to a hinge 1 for doors or windows, comprising two blades 2 and 3, one of which is fitted to the casing of the door or the window, with the other attached firmly to the leaf.

Very frequently, the blades have a form designed specifically for each use of this hinge and considering their independent nature as regards this invention, there is no interest in providing any detailed description thereof. FIG. 1 has been chosen for reasons of convenience and it shows a hinge of which the blades present a configuration specific to their use.

In all the cases, these blades display the component elements of this invention. Thus, blade 2 is provided with two end knuckles 4 and 5 arranged one above the other, and it has a boring, respectively 6 and 7. The axis of the boring 6 of the knuckle 4 lies in the vertical extension of the axis of the boring 7 of the knuckle 5. All of the outer measures of the end knuckles 4 and 5 may vary in size that depends on the pressures applied to the hinge. These sizes will be determined easily by the specialist.

Between these two end knuckles 4 and 5 is provided a space that allows for installing a central knuckle 8 on the blade 3. This central knuckle 8 has a boring 9 that opens into a housing 11 in which is installed a plug 12.

According to a different mode of embodiment, the central knuckles 8 comprises two housings 11 located on both sides of the boring 9. The plug 12 is provided with a flange 13 that abuts on the end face 14 of the central knuckle 8. Thus, the distance 15 that separates the two end knuckles 4 and 5 of the blade 2 is equal to the sum of the length of the central knuckle 8 and either once or twice the thickness 16 of the flanges 13, so as to allow the central knuckle 8 fitted with its plug(s) 12 to become engaged between the two end knuckles 4 and 5. The axis of the boring 9 will then lie in the same vertical extension as the axes of the borings 6 and 7.

Into the knuckles 4, 5 and 8 is engaged a pin 17, the diameter of which is slightly smaller than the diameter of the various borings 6, 7 and 9 in order to allow the latter to provide for perfect guiding for the aforesaid pin 17.

Figure 2:
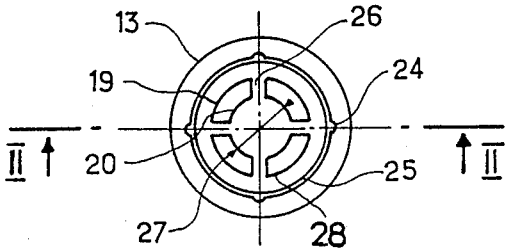
FIG. 2 is an underside view of the plug that allows for resisting an axial shifting of the pin.
Figure 3:
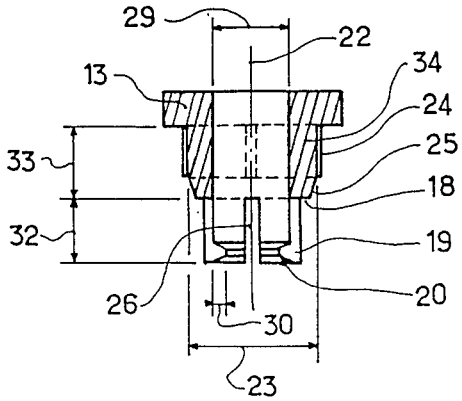
FIG. 3 is a frontal and sectional view taken along the line II—II of FIG. 2.

We refer to FIGS. 2 and 3.

According to one characteristic feature of this invention, the plug 12 engaged into a housing and that comprises at one of its ends the flange 13 that abuts on one end face 14 of the central knuckle 8, is provided at the other end 18 with elastic jaws 19 fitted with catches 20 that enter into a peripheral groove 21 made in the pin 17. Within the framework of the mode of embodiments with two housings 11 and, consequently, with two plugs 12, the pin 17 has two peripheral grooves 21. In order to ensure perfect support for the plug 12 in directions perpendicular to its vertical axis 22, it will be necessary to provide for an adequate fit between the outer diameter 23 of the plug 12 and the inner diameter of the housing 11.

According to a first mode of embodiment, the jaws 19 consist of elastic metal strips.

According to another mode of embodiment, these jaws 19 are made of elastic plastic material. If required, the entire plug 12 may be made of plastic material.

In order to make assembling the hinge 1 easier, the plug 12 may be provided with a variable number of vertical bulges 24 located on its outer surface area. These vertical bulges 24 will effect a tightening between the housing 11 and the plug 12 and prevent any unexpected shifting of the latter in an axial direction in the course of assembling. Furthermore, a chamfer 25 at the end 18 of the plug 12 will make engaging the latter into its corresponding housing 11 easier.

The jaws 19 are firmly attached to the end 18 and they have, to a large extent, the shape of a cylinder in which have been made vertical cutouts 26. According to one mode of embodiment of this invention, there are four of these jaws 19 and they are perfectly symmetrical as compared to the vertical axis 22 of the plug 12. It is obvious that by increasing the number of vertical cutouts 26, it will be possible to increase the number of jaws 19, but the latter will then have lower strength.

One catch 20 located at the end of a jaw 19 consists in a bulge in the form of a circular arc located at the free end of the jaw 19, with this catch 20 pointing toward the inside of the plug 12. The inner diameter 27 of the circle 28 formed by all the catches 20 is smaller than the diameter of the spindle 17.

The jaws 19 delimit a cylinder-shaped inner space with a diameter equal to the inner diameter 29 of the plug 12. On the other hand, the outer diameter of the jaws 19 is equal to the inner diameter of the boring 31 of the housing 11 less twice, at least, the thickness 30 of the catches 20. In this manner, we obtain an empty space 10 between the boring 31 of the housing 11 and the outer diameter of the jaws 19. Therefore the jaws 19 will be able, because of their elasticity, to spread sufficiently to cause the catches 20 to withdraw when the pin 17 comes through.

Figure 4:
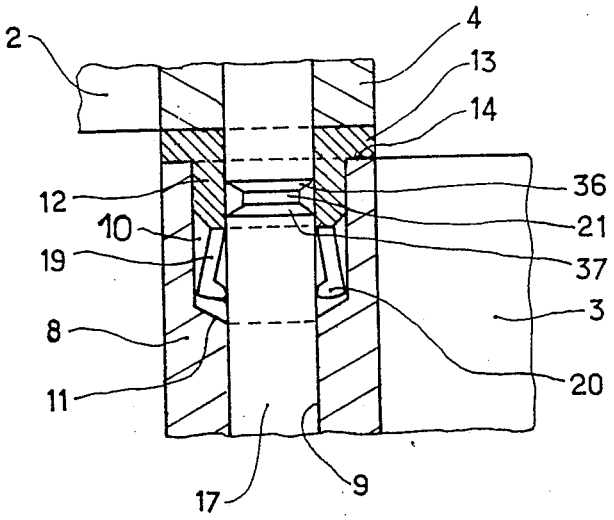
FIG. 4 is an enlarged view of part "A" of FIG. 1, show the plug and the pin in the course of the engaging process.

FIG. 4 shows the position of the pin 17 and of the plug 12 when they are being assembled. Through its outer diameter, the pin 17 exerts pressure on the catches 20 and this pressure causes the jaws 19 to spread via elastic deformation of the material at the level of their connection to the end 18 of the plug 12. Under a leverage effect resulting from the length of the jaws 19, the force applied to the catches 20 is significantly reduced. From this results an improved resistance to wear.

The length of the jaws 19 may vary because of their elasticity. However, the sum of their length 32 and of the height 33 of the body 34 of the plug 12 has to be equal to or smaller than the height 35 of the housing 11.

Figure 5:
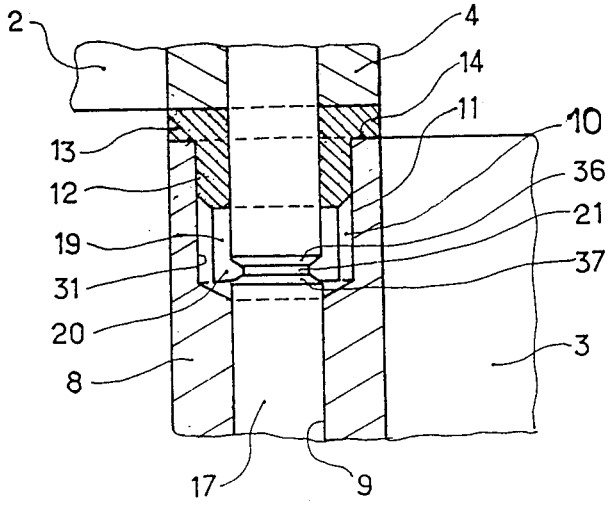
FIG. 5 is an enlarged view comparable to FIG. 4, showing the plug and the pin at the end of the assembly process, in an operational position.

FIG. 5 shows the elements of FIG. 4, with the pin 17 in the position as assembled in the hinge 1. The catches 20 of the plug 12 are in their position for entering the peripheral groove 21 which ensures a perfect support of the pin 17 against any shifting of the latter in its axial direction, with the understanding that if the central knuckle 8 has two plugs 12, the catches 20 of the latters will enter into the respective peripheral grooves 21. To note that the support and guiding of this pin 17 in the directions perpendicular to its axis are ensured by the boring 9 of the central knuckle 8 and by the borings 6 and 7 of the end knuckles 4 and 5.

According to a special mode of embodiment of the peripheral grooves 21 of the pin 17, the lateral sides 36 and 37 have the shape of a flattened cone so as to make the withdrawing of the pin 17 from the catches 20 easier, without damaging the latter or the jaws 19.

According to another mode of embodiment, the peripheral grooves 21 have a semicircular section.

This invention also concerns hinges that comprise two blades, each of which is provided with only one knuckle. In this case, one of the knuckles may comprise one housing 11 only and, consequently, one plug 12 only, fitted on the side where the two knuckles are joining. It is also possible for one and the same knuckle to have two housings 11 and two plugs 12, but it is preferable, in this case, to engage the second plug 12 after the pin 17 has been installed.

During the assembling, we proceed in the following manner: we engage first the plugs 12 in the housings 11 of the central knuckle 8 of the blade 3, with the central knuckle 8 topped by the flanges 13 of the plugs 12, installed between the end knuckles 4 and 5 of the blade 2 in such a manner that the borings 6, 7 and 9 lie in the vertical extension, one of the other. Then we engage the pin 17 at its end 38 into the end knuckle 5 and in the central knuckle 8 until they meet the catches 20 of the first plug 12. One applies pressure to the end 39 of the pin 17 thus causing the jaws 19 to spread and the catches 20 to withdraw. This assembly will be made easier by a chamfer 40 provided at the end 38 of the pin 17.

To make sure of the entering position of the catches 20 of the two plugs 12 in their respective peripheral groove 21, we have these peripheral grooves 21 located in places such as the end 39 of the pin 17 i.e. flush with the inner face 41 of the end knuckle 5.

In order to be able to use the hinge 1 equally well at the top or the bottom section of the door or window, the various elements of the hinge 1 are symmetric compared to a horizontal median plane 42. Thus, the pin 17 can be engaged equally well from the bottom toward the top as from the top toward the bottom.

In order to disengage the pin 17 from its assembled position, pressure has to be applied to its end 38 provided with the chamfer 40. A peripheral groove 43 located near the end 39 of the pin 17 then disengages from the end knuckle 5 and makes the prehension of the pin 17 easier, using an adequate tool in view of exerting sufficient pull to extract it.

We claim:

1. A hinge for use in rotationally securing a rotational member to a fixed member, said hinge comprising a first blade and a second blade, one of said first blade and said second blade being adapted to be secured to said rotational member and the other of said first blade and said second blade being adapted to be secured to said fixed member, said first blade having a central knuckle and said second blade having two end knuckles, said central knuckle being positioned between said two end knuckles, a pin extending axially through and engaging said two end knuckles and said central knuckle and providing for the free rotation of said first blade relative to said second blade, said pin having at least a first peripheral groove, said central knuckle provided with a bore, having a diameter sufficient to receive said pin and having at least one region of increased diameter, a locking plug positioned in said at least one region of increased diameter and having a cylindrical shaped body and two ends, wherein at least at one of said two ends, is provided with a jaw and at the other of said two ends with a flange wherein, said jaw has a plurality of axially extending elements, provided with a catch positioned for engagement with said first peripheral groove of said pin and, wherein said flange is positioned between the central knuckle and one of said end knuckles so as to be adapted to position the locking plug in the bore of the central knuckle by abutting a surface of the central knuckle.

2. A hinge according to claim 1 wherein said pin comprises two peripheral grooves that cooperate with said locking plug.

3. A hinge according to claim 1 wherein pin comprises said first peripheral groove at one end thereof and a chamfer at another end thereof.

4. A hinge according to claim 1 wherein the pin comprises a peripheral groove positioned along a length thereof such that when the groove is engaged by the catch a lower end of the plug is flush with a lower surface of one of said end knuckles.

* * * * *